United States Patent [19]

Foote

[11] 4,150,372

[45] Apr. 17, 1979

[54] HUMIDITY CONTROL SYSTEM

[76] Inventor: Allen M. Foote, Box 68, Dana, N.C. 28724

[21] Appl. No.: 849,396

[22] Filed: Nov. 7, 1977

[51] Int. Cl.[2] ..... G08B 21/00

[52] U.S. Cl. ..... 340/620; 261/72 R; 261/104

[58] Field of Search ..... 340/235, 244 C, 243, 340/602, 620; 98/105, 109; 261/24, 28, 29, 72 R, 104, 142

[56] References Cited

U.S. PATENT DOCUMENTS

| | | | |
|---|---|---|---|
| 1,683,362 | 9/1928 | Loffler | 340/244 C |
| 2,600,659 | 6/1952 | Koch, Jr. | 200/84 B |
| 3,304,066 | 2/1967 | Vieceli et al. | 261/29 |
| 3,323,784 | 6/1967 | Fazio | 261/142 X |
| 3,339,578 | 9/1967 | Smith | 340/244 C |
| 3,399,399 | 8/1968 | Apfelbaum | 340/244 C |
| 3,580,158 | 5/1971 | Scholle et al. | 340/244 C X |

*Primary Examiner*—John W. Caldwell, Sr.
*Assistant Examiner*—Daniel Myer
*Attorney, Agent, or Firm*—Clarence A. O'Brien; Harvey B. Jacobson

[57] ABSTRACT

A humidity control system, such as can be used with a piano to control the level of humidity within the interior of the piano, is comprised of a low water measuring/warning sub-system and a "blind" refill sub-system. The low water measuring/warning sub-system comprises stainless steel probes extending below the water level in a humidifying unit when the unit is filled with water. When the water in the humidifying unit is sufficiently high to cover the ends of the probes, a neon light is shorted, the absence of light emission from said neon light thereby indicating a sufficient water supply to be present in the humidifying unit. Evaporation of the water to a level below the ends of the probes causes a circuit including the neon light to be completed, thereby causing the light to be lit and indicating that the water supply in the humidifying unit has been diminished by a predetermined amount and can be replenished by said predetermined amount without the need for visual observation of the humidifying unit. The "blind" refill sub-system comprises a water refill conduit fixed in operative relation to the humidifying unit, the conduit having a water-receiving funnel attachable to the distal end thereof and disposed for convenient access such that the humidifying unit can be exactly refilled without the need for visually observing the unit to avoid overfilling.

6 Claims, 11 Drawing Figures

Fig. 1
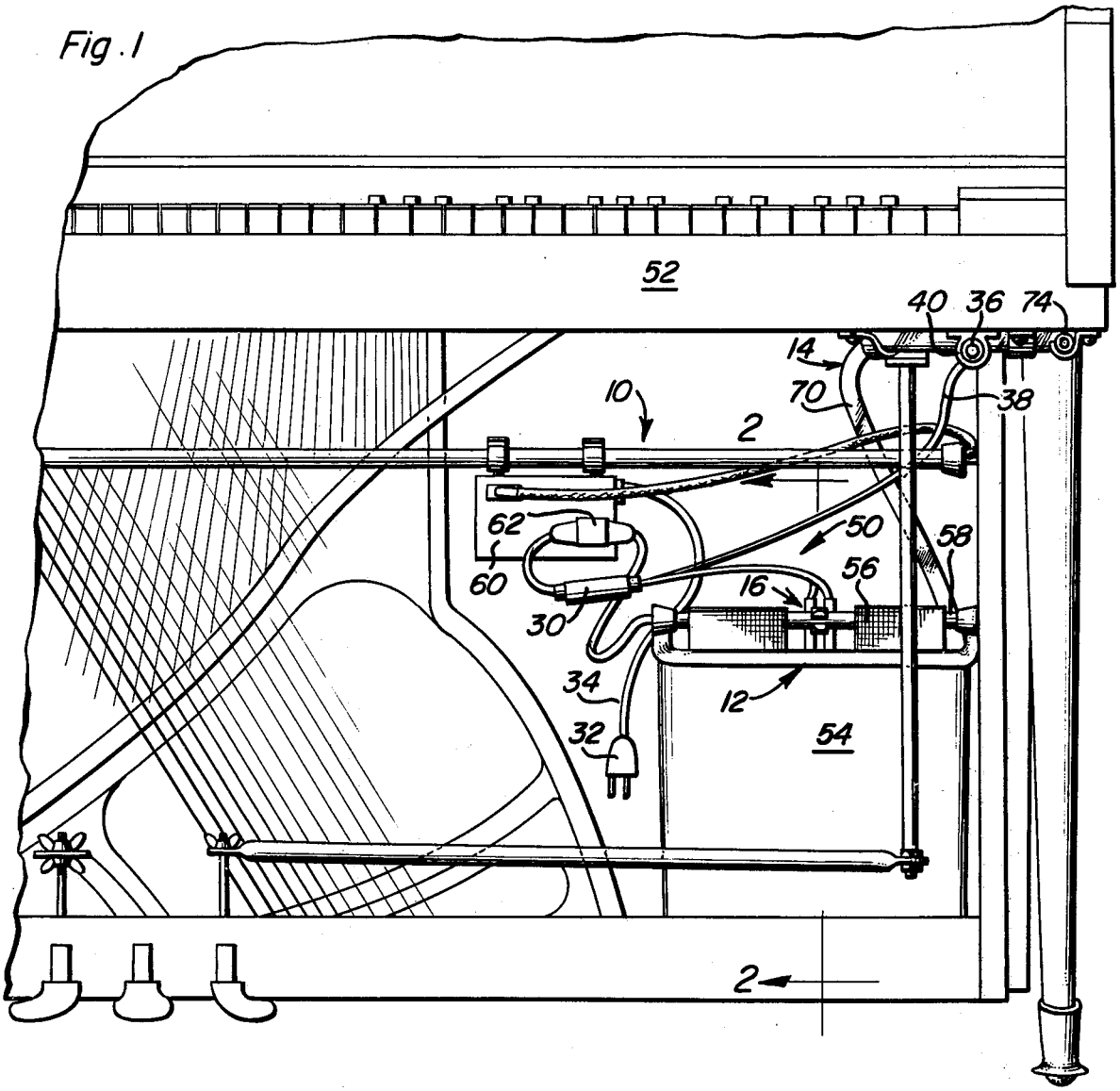
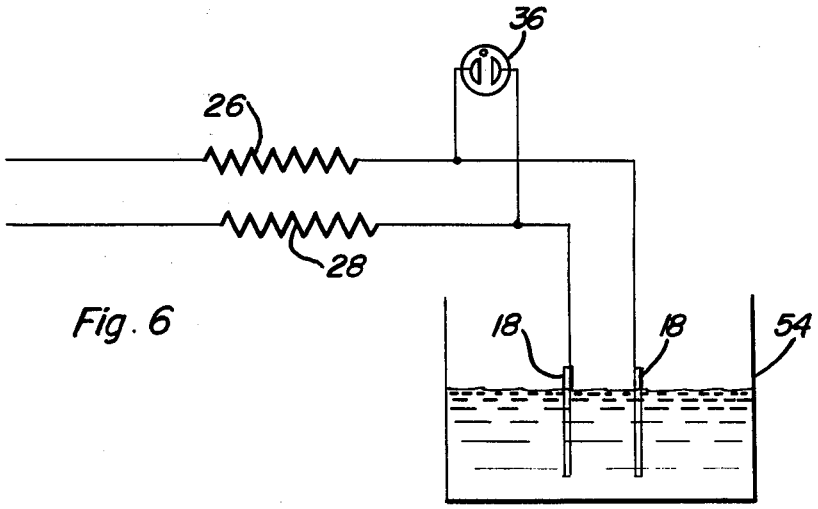
Fig. 6

HUMIDITY CONTROL SYSTEM

BACKGROUND AND SUMMARY OF THE INVENTION

Liquid level indicators have previously been disclosed which include indicator lights for indicating the level of a liquid in a container. Turner, in U.S. Pat. No. 1,093,745, discloses a level indicating device which includes a plurality of vertically spaced light bulbs, the light bulbs being energized or deenergized to indicate liquid levels. Huckabee, in U.S. Pat. No. 2,700,153, provides a low water warning signal for the coolant of an engine in order that the engine may be stopped in the event of low coolant level. Smith, in U.S. Pat. No. 3,339,578, discloses an indicator light circuit in which conductors electrically connected to electrodes include resistors and a neon light connected between the conductors, the light being illuminated when the water level falls below the probes. Seil, in U.S. Pat. No. 3,253,820, discloses a water level indicator combined with a portable humidifier operated by a float and switch structure.

The invention relates generally to systems for maintaining a desired level of humidity, such as can be adaptable for use with a piano, it being beneficial to maintain a substantially constant and predetermined humidity level within the interior of a piano. However, the invention finds general application as a liquid level measuring and warning device and can be particularly useful when refill of the system with water cannot be readily observed, the present system indicating that the water level therewithin has been diminished by a predetermined amount and can be replenished by said predetermined amount without fear of overfilling the system even though the portion of the system containing the water is not visible to the user. The invention is further useful in a humidifying system wherein heat is applied by means of an adjustable heating rod to evaporating pads projecting into a reservoir of water. The present humidity control system comprises a water level indicating device provided with a pair of probes which extend into the reservoir of water, the device being electrically controlled by means of a dual humidistat which is plugged into an electrical outlet, there being no waste of current or power in creating humidity in the system. The probes are present in a circuit with a neon indicator light, the circuit being shorted when the water level in the reservoir is sufficiently high to at least cover the lower ends of the probes. Evaporation of the water to a level below the ends of the probes causes the circuit to be completed, thereby activating the neon indicator light. Replenishment of the water supply in the reservoir is thus indicated as being necessary, the amount of water required to so replenish the water supply in the reservoir being a predetermined amount which can thus be added to the reservoir by means of a water conduit extending into the reservoir at the anterior end of said conduit and being located for convenient access at the distal or free end thereof. A predetermined quantity of water can thus be charged into the reservoir through the conduit without overfilling thereof, the reservoir being thereby filled without the need for visual observation thereof. The circuit of the invention further includes a pair of limiting resistors which limit the current within the circuit to 0.5 milliamperes, the maximum allowed in view of safety considerations. The limiting resistors extend the life of the neon indicator lamp to a period of 20 years or more. The neon indicator light is preferably mounted in a tube assembly having a strain relief bushing provided therein so that a wire connecting the indicator light to the circuit cannot accidentally be pulled from the light.

Accordingly, it is an object of the present invention to provide a humidity control system comprising a liquid level measuring, indicating, and refill device, the device comprising a pair of probes and a neon indicator light in a suitable circuit, the probes being disposed within a liquid reservoir, the level of the liquid therein allowing the circuit to either be completed or be shorted out such that the indicator light is lit when the level of liquid in the reservoir is at a predetermined low level.

It is another object of the invention to provide a humidity control system having a water measurement-/warning sub-system and a "blind" refill sub-system, the measurement/warning sub-system indicating the diminution of the water supply in the system by a predetermined amount, the "blind" refill sub-system allowing replenishment of the water supply without the need for visual observation of the water-containing portion of the system to prevent overfilling.

If is a further object of the invention to provide a humidity control system which is readily incorporated into a unitary cooperating construction, which is portable, and which is adapted to be plugged into any readily available electrical outlet.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is an elevational front view of an upright piano exposing the sounding board, a humidity control system according to the invention being installed within the piano;

FIG. 6 is a schematic view of the circuit of the measuring/warning sub-system of the invention;

DESCRIPTION OF THE PREFERRED EMBODIMENTS

Figure 2:
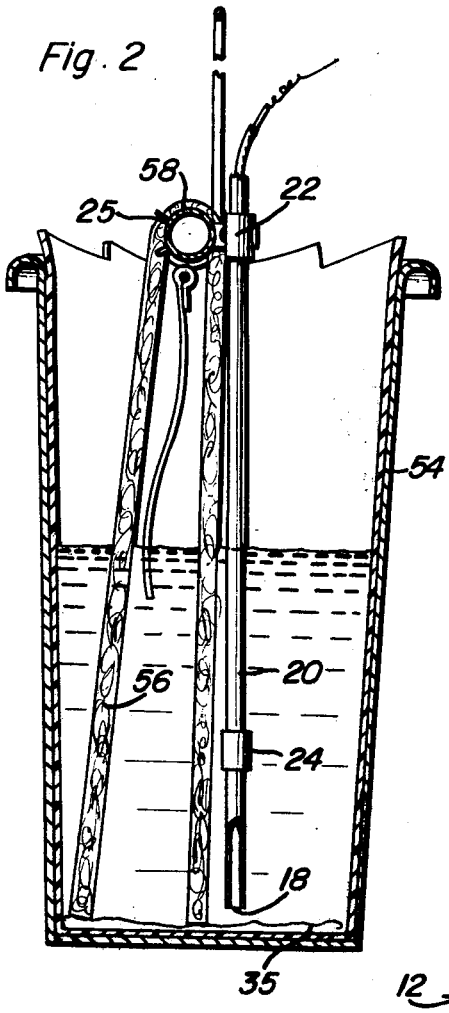
FIG. 2 is an elevational view in partial section of the water reservoir of the humidity control system of FIG. 1, portions of the measurement/warning portion of the system being being also shown.

Referring now to drawings and particularly to FIGS. 1 through 3 and 7, the present humidity control system is shown generally at 10 to comprise a measuring/warning sub-system 12 and a "blind" refill sub-system partially shown at 14. The measuring/warning sub-system 12 comprises a probe unit 16 which includes a pair of stainless steel rods 18. The rods 18 are held within and insulated from each other by insulative sleeves 20, the rods 18 essentially "floating" freely within the sleeves 20 and being held therewithin as will be described hereinafter. The sleeves 20 act to prevent accidental shorting of the rods 18, the ends of said rods 18 being recessed from the ends of the sleeves 20 an appropriate distance, such as ¼ inch, to prevent contact with extraneous matter. The inner diameter of each of the sleeves 20 is greater than the outer diameter of each of the rods 18, water thereby readily flowing into the interior of the sleeves 20. The rods 18 are particularly caused to be centered within the sleeves 20, contact between the surfaces of the rods 18 and the inner surfaces faces of the sleeves 20 being prevented in order to obviate accidental shorting due to electrical leakage paths which might occur in the event of substantial contact between the rods 18 and the inner surfaces of the sleeves 20. The rods 18 are electrically connected at anterior ends thereof to insulated wires 19, the sleeves 20 maintaining the rods 18 in a substantially "floating" insulatively spaced relation as referred to hereinabove and as will be described in greater detail hereinafter. The sleeves 20 are held together by fasteners 22 and 24 at upper and lower portions respectively of said sleeves. The fastener 22 is further provided with a clip 25 which facilitates mounting of the probe unit 16 within a liquid reservoir. The electrically conductive wires 19 form a portion of a circuit which includes limiting resistors 26 and 28, which resistors are housed within an insulated resistor housing 30. A mylar layer 31 insulates the resistors from the housing 30. An electrical plug 32 is electrically connected in the circuit, the plug 32 being connected to the resistor housing 30 by means of an electrically conductive wire 34. A neon indicator light 36 is disposed within the circuit and is connected to the resistor housing 30 by means of an electrically conductive wire 38. The light 36 is mounted by a housing 40, the housing 40 providing a strain relief bushing therewithin (not shown) so that the wire 38 cannot be pulled from electrical contact with the light 36.

As particularly seen in FIGS. 1 and 2, the humidity control system 10 including the measuring/warning sub-system 12 thereof can be installed within a piano 52. The system 10 further comprises a humidifier tank 54 which is filled with water to a desired level. Pads 56 of a capillary material absorb water from the tank 54, the water absorbed in the pads 56 being heated by a heater tube 58, power to the heater tube 58 being controlled by a humidistat and associated power producing unit 60. The several components of the system 10 and of the sub-system 12 can be conveniently mounted within the interior of the piano 54 as indicated in FIG. 1. The probe unit 16 is seen to be disposed within the interior of the tank 54, lower portions of the rods 18 being usually located below the safe full level of water in the tank. As can be schematically seen in FIG. 6, the water level in the tank 54, when said water level is sufficiently high to cover the lower ends of the rods 18, causes the power circuit to the light 36 to be shorted out due to the electrical conductivity of the water. When the water level evaporates to a level below the ends of the rods 18, the power circuit in which the light 36 is disposed is unshorted and thus completed through the light 36, thereby illuminating said light. A user of the device is thus alerted to the fact that the water level within the tank 54 has been decreased by a predetermined volume of water, the volume of water thereby being necessary to replenishment the water supply within the tank without overflowing of said tank being known. As described hereinafter, the "blind" refill sub-system of the invention can conveniently be used to replenish the water supply within the tank 54 without overfilling of said tank and without the need for visual observation of the tank 54 during replenishment of the water supply therewithin. The lowermost ends of the sleeves 20 are maintained approximately one inch from the bottom of the tank 54 so that advance warning is provided prior to complete loss of water from the tank 54 and to prevent accidental shorting of the probe unit 16 due to bunching of the pads 56 or accumulation of trash or sediment.

Figure 3:
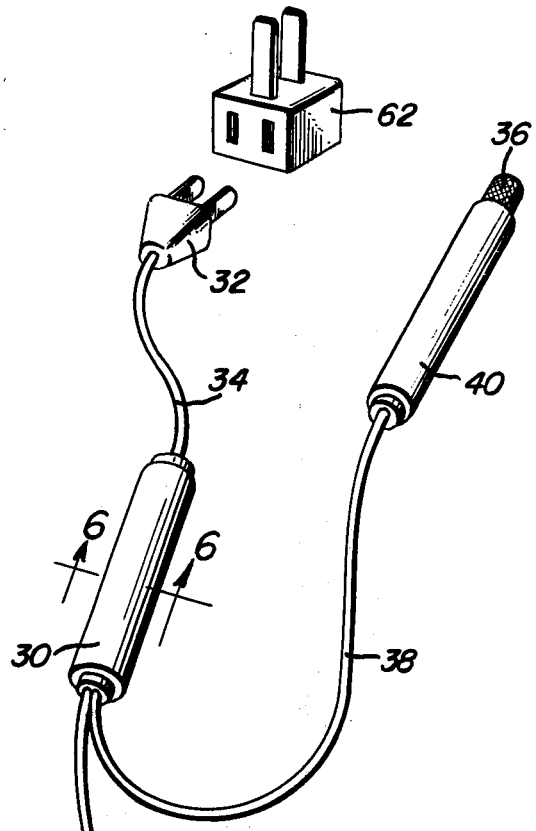
FIG. 3 is a perspective view of the measuring/warning sub-system of the present invention.
Figure 4:
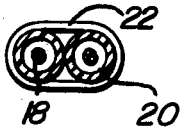
FIG. 4 is a sectional view taken along line 4—4 of FIG. 3.
Figure 4:
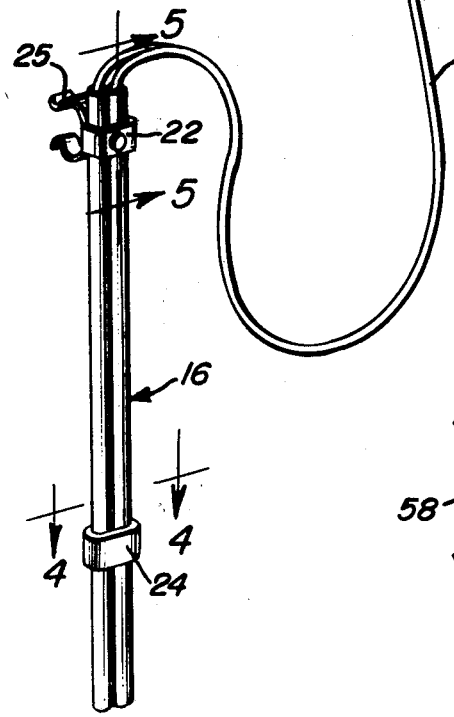
Figure 7:
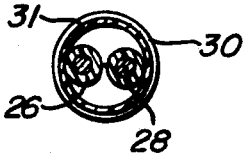
FIG. 7 is a sectional view taken along line 6—6 of FIG. 3.
Figure 5:
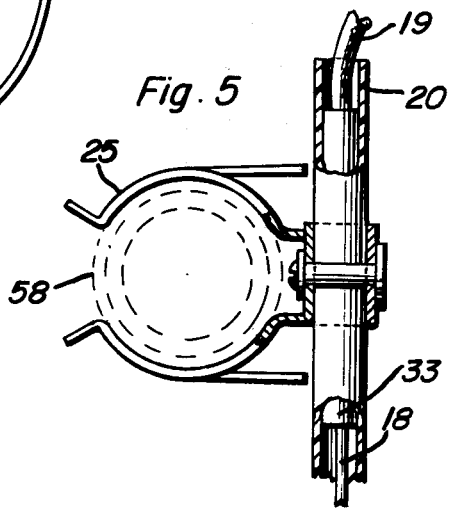
FIG. 5 is a sectional view taken along line 5—5 of FIG. 3.
Figure 8:
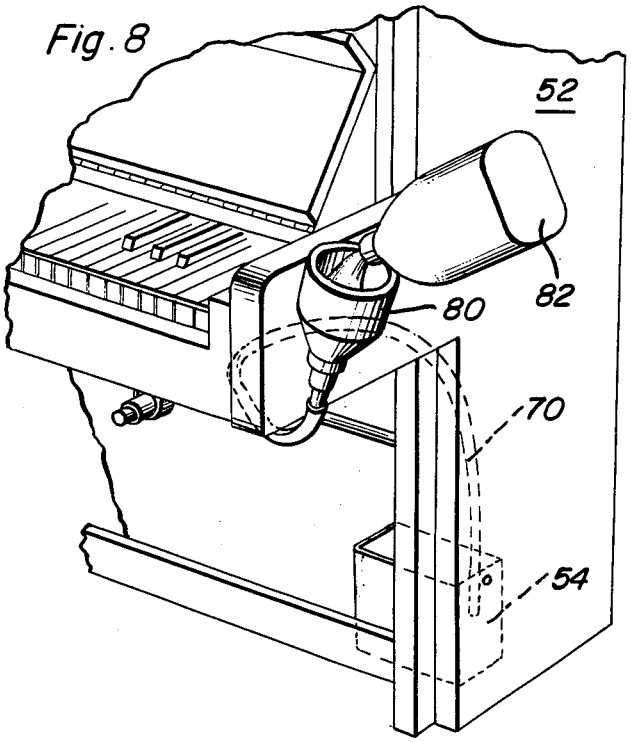
FIG. 8 is a perspective view of the "blind" refill sub-system of the invention.
Figure 10:
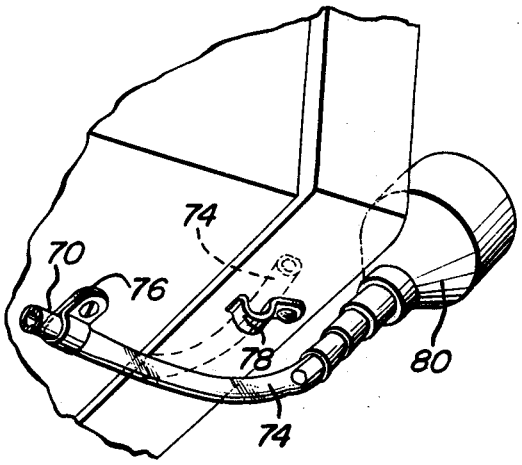
FIG. 10 is a perspective view of the distal or free end portion of the "blind" refill sub-system of the invention; and, FIG. 11 is a partial assembly view in perspective of a portion of the "blind" refill sub-system.

Referring now to FIGS. 2 and 5, the clip 25 is seen to be used to mount the probe unit 16 to the heater tube 58 in order to facilitate use of the sub-system 12 within the system 10. A two-way plug 62, as shown in FIGS. 1 and 3, can also be used to facilitate connection of the sub-system 12 and the heater tube 58 of the system 10, the plug 62 being used to connect said sub-system 12 and said heater tube 58 into a convenient wall outlet or other source of electrical power, which source of electrical power preferably being the unit 60 which can comprise a humidstat. The limiting resistors 26 and 28 limit the current within the circuit to 0.5 milliamperes to allow safe use of the sub-system 12 within the tank 54.

As can be readily seen in FIG. 5, each steel rod 18 is spaced from the inner surfaces of the sleeves 20 by insulated crimp lugs 33, the lugs 33 substantially comprising tubular pieces of insulative material disposed interiorly of each sleeve 20 at the upper portion thereof between the inner surface of said sleeve 20 and the outer surface of each rod 18. A portion of the rod 18 is held within the interior of the tubular lug 33.

Figure 9:
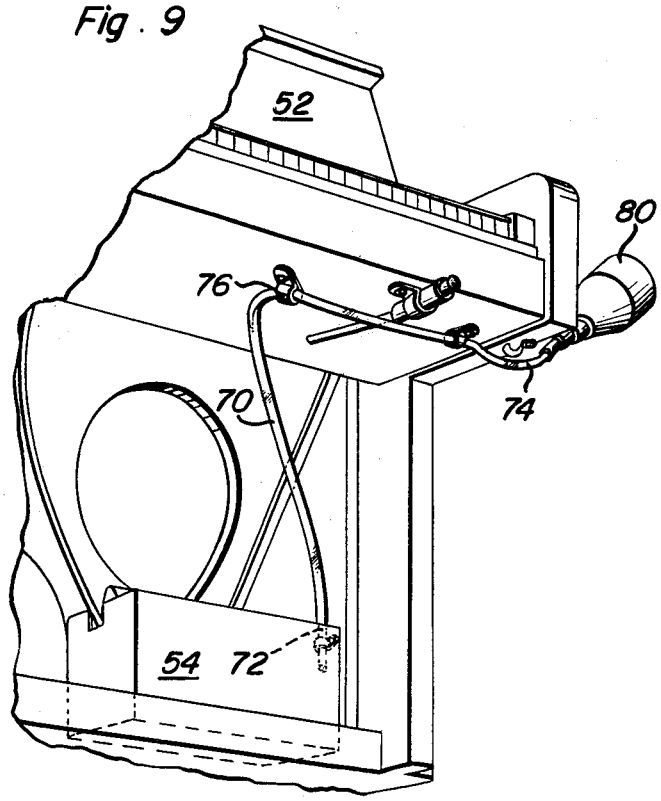
FIG. 9 is a perspective view of the "blind" refill sub-system of the invention seen from an angle differing from the view of FIG. 8.
Figure 11:
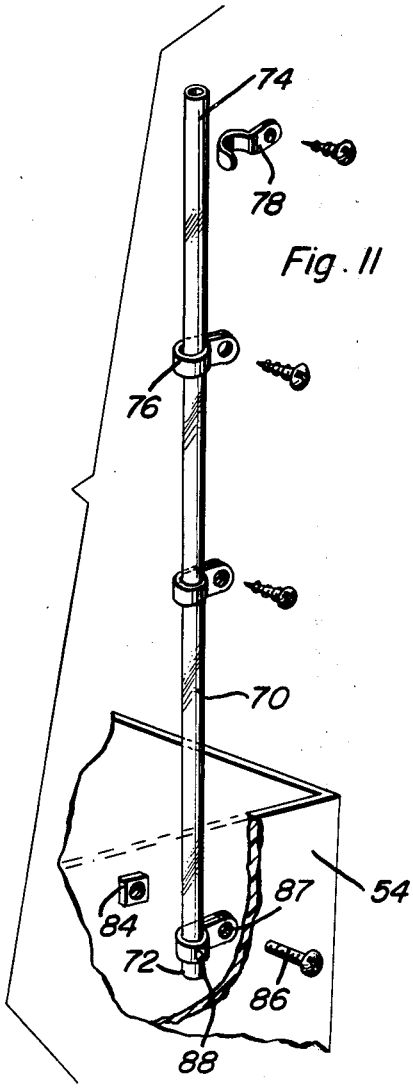

Referring now to FIGS. 1 and 8 through 11, the "blind" refill sub-system of the invention is seen to comprise a water supply conduit 70 having an anterior end 72 mounted within the interior of the tank 54. Free end 74 of the water supply conduit 70 is seen to be removably mounted at a location vertically spaced from the tank 54, the free end 74 being located in a position convenient for use of the conduit 70. When used in the humidity control system 10 incorporated into the piano 52, the supply conduit 70 extends from the tank 54 to a position under the keyboard of the piano, the conduit 70 being attached by fasteners 76 to maintain said conduits 70 in mounted relation to the piano. The free end 74 of the conduit 70 is releasably monted as shown in phantom in FIG. 10 by an open, U-shaped clip 78, the free end 74 being removable from said clip 78 when the horizontal portion of the conduit 70 is to be used to form an "L" so that a funnel 80 can be held vertically for filling as seen in FIG. 9. The funnel 80 is inserted into the free end 74 to facilitate refilling of the tank 54. A container 82 which preferably contains a premeasured quantity of water sufficient to recharge the tank 54 is used to pour water into the funnel 80, the water therefore draining through the conduit 70 into the tank 54 to allow refilling of said tank without the need for visual observation of the tank. As can be seen particularly in FIG. 11, a fastener 87 can be used along with a nut 84 and bolt 86 to securely fasten the anterior end 72 of the conduit 70 to a wall of the tank 54, an aperture in the loop portion of the fastener receiving a small screw 88, the screw 88 penetrating the conduit 70 to prevent the conduit from slipping out of the fastener 87. Since the measuring/warning sub-system 12 of the system 10 activates the light 36 when a predetermined amount of water has evaporated from the tank 54, the "blind" refill sub-system 14 can be conveniently used to refill said tank 54 with a predetermined amount of water equal to that amount which has evaporated from the tank, it not being necessary for a user to visually observe the tank 54 in order to prevent overfilling thereof. In this manner, the tank 54 can be conveniently disposed in locations difficult to directly reach or observe, the tank 54 being readily refillable even though so located.

The foregoing is considered as illustrative only of the principles of the invention. It is to be understood that differences in structure, such as a combination of the housings 30 and 40 into a single housing containing the resistors 26 and 28 and the light 36, are within the scope of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a humidity control apparatus having a container, said container comprising a closed bottom, upstanding side walls, and an open top, a heater disposed in surmounting relation to said upstanding side walls, said heater being formed in a generally cylindrical shape, the improvement comprising:

means for indicating the liquid level in the container including a probe means having a pair of electrically conductive rod members with each rod member having a length approximating the height of said upstanding side walls and said rods being maintained in spaced relation to each other by connection to a mounting means, said mounting means also including a resilient clip means for attaching said rod members in a depending position from said heater, said clip means being resiliently attachable about the outer peripheral surface of said heater to hold said rod members in a depending position in said container with each rod member having one free end maintained proximate to but spaced from the bottom of said container, circuit means connecting the probe means with an indicator light, the circuit including a power source means, the indicator light being shorted when the level of the liquid is above said free ends of said rod members, the light being illuminated when the liquid level is below the free ends, and means for refilling the container from a position spaced from said container with a predetermined amount of liquid on indication of the attainment of the said predetermined liquid level by said liquid level indicating means, the predetermined amount of liquid being that amount of liquid required to restore the liquid level in the container to a predetermined maximum level, the predetermined amount of liquid being thereby chargeable into the container without the need for visual observation of the container.

2. In the apparatus of claim 1 wherein said spaced electrically conductive rod members are provided with an insulative sleeve member disposed over each of the rod members and preventing contact between said rod members.

3. In the apparatus of claim 2 wherein the probe means further comprise:

spacer means for preventing contact between each rod member and the insulative sleeve member disposed thereover, the inner diameter of the sleeve member being greater than the outer diameter of the rod member to allow liquid to flow therebetween.

4. In the apparatus of claim 3 wherein the spacer means comprise a tubular member formed of insulative material, one of the tubular members being substantially flushly received within one end of each of the sleeve members at the end thereof not in contact with the liquid, a portion of the rod member disposed within each sleeve member being received and held within said tubular member.

5. In the apparatus of claim 1 and further comprising limiting resistor means disposed in the circuit means for limiting the power within portions of the circuit means in contact with the liquid.

6. In the apparatus of claim 1 wherein the refilling means comprise:

a liquid supply conduit having the anterior end thereof mounted within the interior of the container and a free end thereof located remotely from the container for convenient access by a user;

funnel means for insertion into the free end of the conduit to receive a quantity of liquid thereinto, the liquid passing through the conduit and into the container.

* * * * *